US008303327B1

(12) United States Patent
Sun et al.

(10) Patent No.: US 8,303,327 B1
(45) Date of Patent: Nov. 6, 2012

(54) CONNECTOR RETAINING DEVICE

(75) Inventors: Zheng-Heng Sun, New Taipei (TW); Li-Ren Fu, Shenzhen (CN); Jun-Hui Wang, Shenzhen (CN); Al-Ling He, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/172,883

(22) Filed: Jun. 30, 2011

(51) Int. Cl.
*H01R 13/62* (2006.01)

(52) U.S. Cl. ..... 439/369

(58) Field of Classification Search ..... 439/369, 439/371

See application file for complete search history.

(56) References Cited

U.S. PATENT DOCUMENTS

| | | | | |
|---|---|---|---|---|
| 1,339,896 | A * | 5/1920 | Kemper | 33/512 |
| 1,784,888 | A * | 12/1930 | Couture | 33/2 R |
| 4,868,990 | A * | 9/1989 | Steinberg | 33/15 |
| 4,869,683 | A * | 9/1989 | Nelson | 439/369 |
| 4,875,296 | A * | 10/1989 | Holzmeister et al. | 33/770 |
| 5,133,671 | A * | 7/1992 | Boghosian | 439/371 |
| 6,401,350 | B2 * | 6/2002 | Ford | 33/562 |
| 6,640,460 | B1 * | 11/2003 | Nabarro et al. | 33/759 |
| 6,868,619 | B1 * | 3/2005 | Boren et al. | 33/760 |

* cited by examiner

*Primary Examiner* — Phuong Dinh
(74) *Attorney, Agent, or Firm* — Altis Law Group, Inc.

(57) ABSTRACT

A connector retaining device for retaining interconnection between two connectors a support board and two flexible fastening strips. The support board includes two through holes. The flexible fastening strips respectively extend through the through holes. Each fastening strip includes a loop at one end thereof, the other end of the fastening strip is passable through the loop. The fastening strips are configured for embracingly gripping the cables at opposite sides of the combined connectors and sandwiching the combined connectors therebetween.

1 Claim, 2 Drawing Sheets

CONNECTOR RETAINING DEVICE

CROSS-REFERENCE TO RELATED APPLICATION

This application is related to two commonly-assigned co-pending applications both entitled "CONNECTOR RETAINING DEVICE" (Ser. No. 13/172,866 and Ser. No 13/172,877). The disclosure of the above-identified applications are incorporated herein by references.

BACKGROUND

1. Technical Field

The present disclosure relates to connector retaining devices, and particularly, relates to a connector retaining device for connecting two unsupported cables to each other.

2. Description of Related Art

In the cable connecting field, a connector device typically includes a first connector and a second connector each connected to a cable end, the first connector and the second connector are coupled with each other for interconnecting the cables.

The first connector and the second connector are connected to each other just by inserting the first connector into the second connector, however the connection has no other support. The first connector and the second connector may be pulled apart from each other by main force, or by unexpected collisions with other objects.

What is needed therefore is a connector retaining device addressing the limitations described.

BRIEF DESCRIPTION OF THE DRAWINGS

The components of the drawings are not necessarily drawn to scale, the emphasis instead being placed upon clearly illustrating the principles of the embodiments of the connector retaining device. Moreover, in the drawings, like reference numerals designate corresponding parts throughout several views.

DETAILED DESCRIPTION

Figure 1:
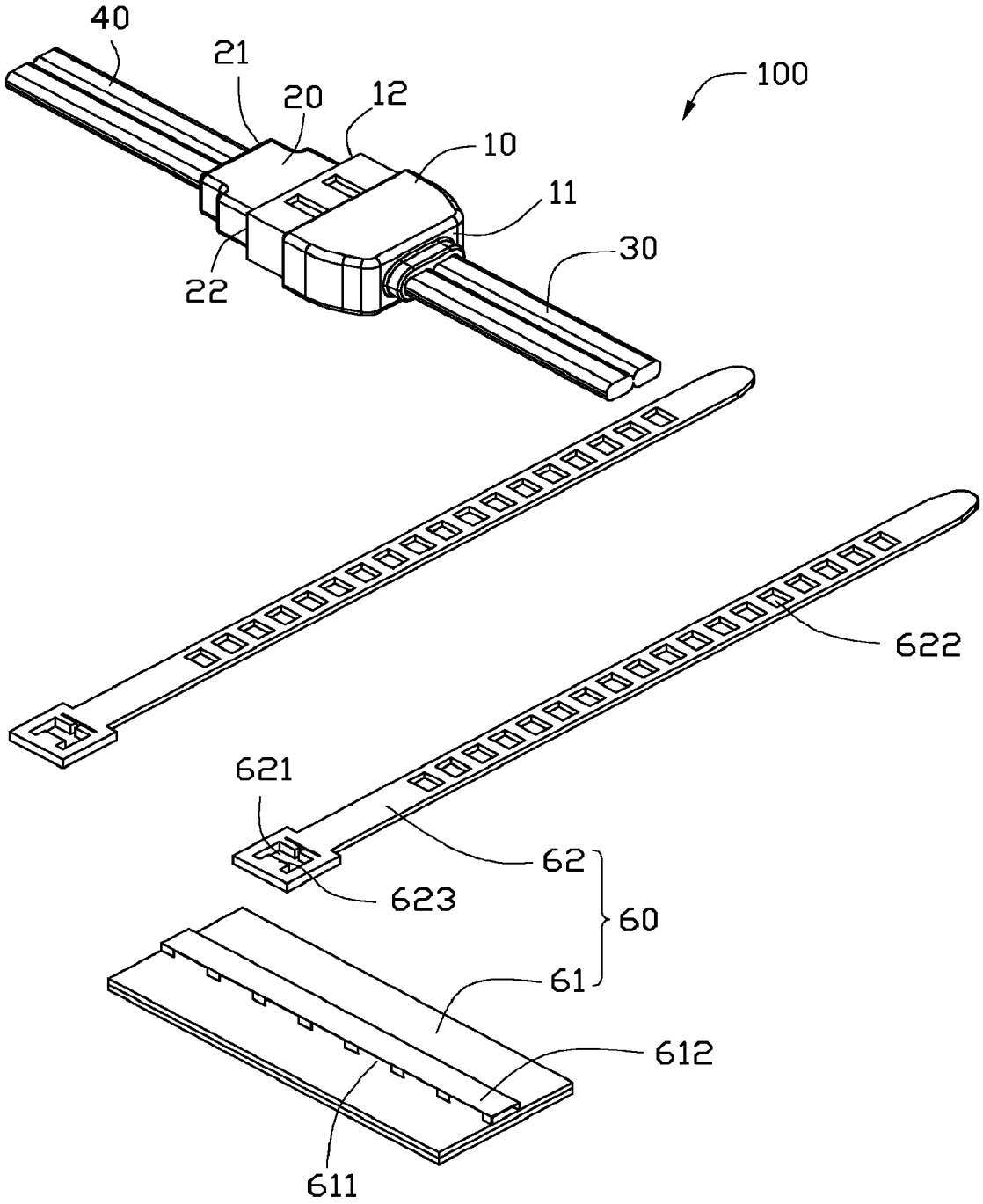
FIG. 1 is an exploded view of a connector retaining device, according to an exemplary embodiment of the present disclosure.
Figure 2:
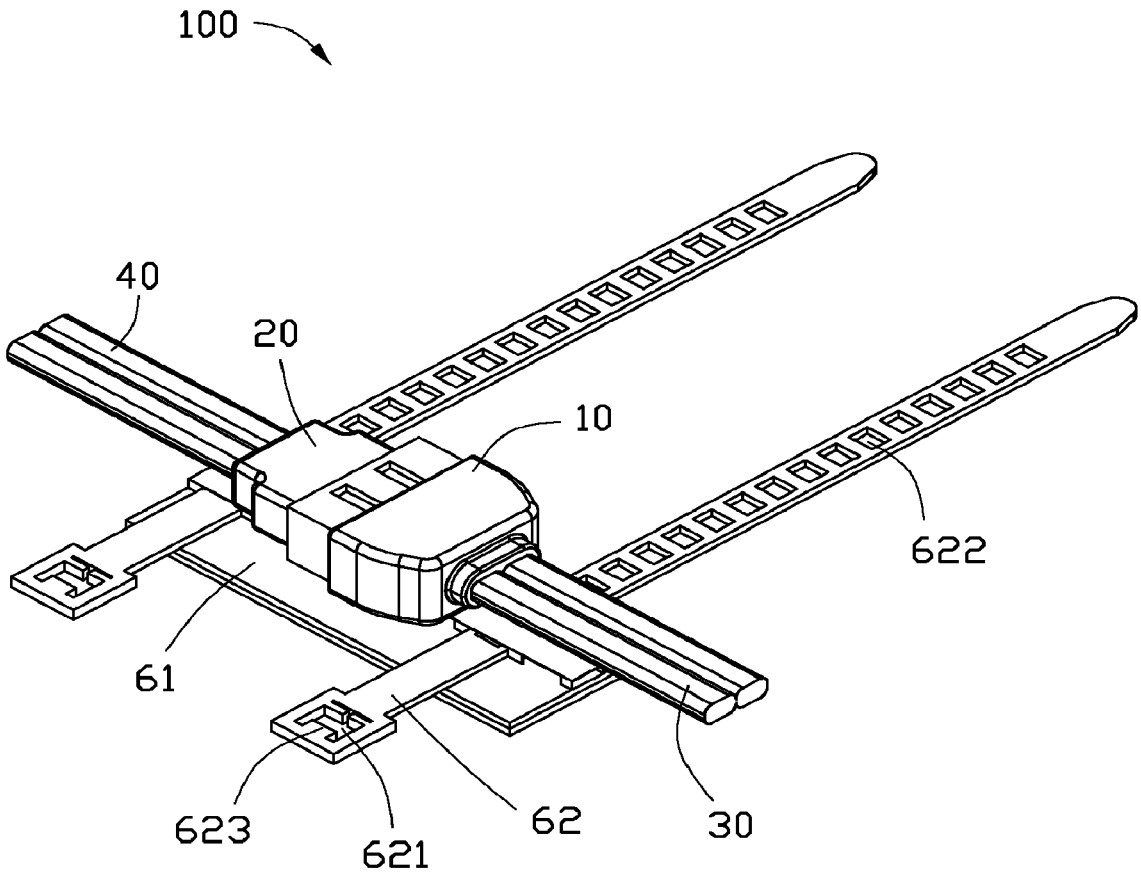
FIG. 2 is an assembled view of the connector retaining device of FIG. 1.

Referring to the FIGS. 1-2, a connector retaining device 100, according to an exemplary embodiment, is shown. The connector retaining device 100 includes a first connector 10, a second connector 20, a first cable 30, a second cable 40 and a security member 60.

The first connector 10 includes a first connecting end 11 and a first insertion end 12 opposite to the first connecting end 11. The second connector 20 includes a second connecting end 21 and a second insertion end 22 opposite to the second connecting end 21.

The first cable 30 is connected to the first connecting end 11 of the first connector 10. The second cable 40 is connected to the second connecting end 21 of the second connector 20. Thus the first connector 10 and the first cable 30 form as a first connector cord (not labeled), and the second connector 20 and the second cable 40 form as a second connector cord (not labeled). The first cable 30 and the second cable 40 can be power cables or data cables. In this embodiment, the first cable 30 and the second cable 40 are Serial Advance Technology Attachment (SATA) cables, and the first connector 10 and the second connector 20 are SATA connectors.

The securing member 60 includes a support board 61 and two flexible fastening strips 62. The support board 61 is substantially rectangular. The support board 61 defines a number of through holes 611 arranged lengthwise along the support board 61. In this embodiment, the support board 61 includes a slender raised rack 612 running along the length of the support board 61, the through holes 611 are defined between the support board 61 and the rack 612. The rack 612 can be integrally formed on the support board 61 or can be affixed thereto in other ways. Each fastening strip 62 defines a loop 621 in an end thereof and a number of locking holes 622 arranged lengthwise on the fastening strips 62. In this embodiment, the locking holes have the same shape and size. Each fastening strip 62 further includes a latch 623 formed on an inner surface of the loop 621. In this embodiment, the latch 623 is formed in an inner surface of the loop 621 furthest from the locking holes 622 and protrudes toward the locking holes 622. Alternatively, the latch 623 can also be formed in an inner surface of the loop 621 nearest the locking holes 622 and protruding away from the locking holes 622.

In assembly, the first connector 10 and the second connector are coupled with each other. The flexible fastening strips 62 are each inserted through a through hole 611 of the support board 61, the distance between the insertion point of each of the flexible strips 62 is substantially equal to that between the first connecting end 11 of the connected first connector 10 and the second connecting end 21 of the female connected 20. The support board 61 is underneath the first connector 10 and the second connector 20. The fastening strips 62 respectively butt against the first connecting end 11 of the first connector 10 and the second connecting end 21 of the second connector 20 to reinforce the integrity as well as the strength of the connection between the first connector 10 and the second connector 20. The fastening strips 62 embracingly grip the first cable 30 and the second cable 40 at opposite side of the combined first connector 10 and second connector 20 and sandwich the combined first connector 10 and the second connector 20. The leading end of each fastening strip 62 is inserted into the loop 621. Thus the latch 623 can selectively engage an locking hole 622. The tightness of the fastening strips 62 can be adjusted by first advancing or retreating the strip in relation to the loop 621, and changing the locking hole 622 into which the block 623 is engaged.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A connector retaining device for retaining interconnection between two connector cords, each of the connector cords including a cable and a connector, the connectors mechanically coupled to each other, the connector retaining device comprising:

a support board comprising two through holes; and two flexible fastening strips extending through the through holes, each fastening strip including a loop at one end thereof, the other end of the fastening strip being passable through the loop, the fastening strips configured for embracingly gripping the cables at opposite sides of the combined connectors and sandwiching the combined connectors therebetween, each of the strips comprising a latch in the loop and a plurality of locking holes arranged along a lengthwise direction of the fastening strip, the latch being selectively engaging in one of the locking holes, wherein the support board comprises a slender raised rack running along a length of the support board, and the through holes are defined between the support board and the rack.

* * * * *

UNITED STATES PATENT AND TRADEMARK OFFICE

CERTIFICATE OF CORRECTION

PATENT NO. : 8,303,327 B1
APPLICATION NO. : 13/172883
DATED : November 6, 2012
INVENTOR(S) : Zheng-Heng Sun et al.

It is certified that error appears in the above-identified patent and that said Letters Patent is hereby corrected as shown below:

Title Page, below Item (22) insert

-- (30) Foreign Application Priority Data

Apr. 28, 2011 (CN) .....201120130821.9 --.

Signed and Sealed this
Twentieth Day of May, 2014

Michelle K. Lee

Michelle K. Lee
*Deputy Director of the United States Patent and Trademark Office*